US009593607B2

(12) United States Patent
Das et al.

(10) Patent No.: US 9,593,607 B2
(45) Date of Patent: Mar. 14, 2017

(54) MUFFLER FOR AN EXHAUST SYSTEM OF AN INTERNAL COMBUSTION ENGINE

(71) Applicant: BOSAL EMISSION CONTROL SYSTEMS N.V., Lummen (BE)

(72) Inventors: Sven Das, Diest (BE); Marc Mentens, Overpelt (BE); Filip Dorge, Lummen (BE)

(73) Assignee: Bosal Emission Control Systems NV, Lummen (BE)

( * ) Notice: Subject to any disclaimer, the term of this patent is extended or adjusted under 35 U.S.C. 154(b) by 0 days.

(21) Appl. No.: 14/964,803

(22) Filed: Dec. 10, 2015

(65) Prior Publication Data

US 2016/0090884 A1 Mar. 31, 2016

Related U.S. Application Data

(63) Continuation of application No. 13/967,121, filed on Aug. 14, 2013, now Pat. No. 9,238,990.

(30) Foreign Application Priority Data

Aug. 16, 2012 (EP) ..... 12180707

(51) Int. Cl.
*F01N 13/08* (2010.01)
*F01N 1/06* (2006.01)
*F01N 1/02* (2006.01)

(52) U.S. Cl.
CPC ..... *F01N 1/026* (2013.01); *F01N 1/06* (2013.01); *F01N 13/08* (2013.01); *F01N 2470/18* (2013.01); *F01N 2470/24* (2013.01)

(58) Field of Classification Search
CPC ..... F01N 2470/02; F01N 2470/04; F01N 2470/18; F01N 2470/024; F01N 1/06; F01N 1/026
(Continued)

(56) References Cited

U.S. PATENT DOCUMENTS 2,189,424 A 2/1940 Leadbetter
3,113,635 A 12/1963 Allen et al.
(Continued)

FOREIGN PATENT DOCUMENTS

CN 2 140 961 8/1993
CN 1 359 623 A 9/2002
(Continued)

OTHER PUBLICATIONS

European Search Report for EP Application No. EP 12180707 mailed Feb. 6, 2013 (6 pages).

*Primary Examiner* — Jeremy Luks
(74) *Attorney, Agent, or Firm* — Merchant & Gould P.C.

(57) ABSTRACT

A muffler for an exhaust system of an internal combustion engine comprises: a casing having an inner space, an inlet pipe for sound to enter the muffler, an outlet pipe for sound to exit the muffler, and a separation wall arranged to extend from the inlet pipe to the outlet pipe and being embodied in a manner such as to define first and second acoustical ducts extending through the casing to allow sound propagating along the first acoustical duct to enter the inner space of the casing and to thereafter exit the inner space of the casing again, and to allow sound propagating along the second acoustical duct to acoustically bypass the inner space of the casing.

5 Claims, 6 Drawing Sheets

(58) Field of Classification Search
USPC ..... 181/247, 248, 250, 253, 266, 273, 276, 181/278, 279
See application file for complete search history.

(56) References Cited

U.S. PATENT DOCUMENTS

| | | | | |
|---|---|---|---|---|
| 3,396,813 | A * | 8/1968 | Hall | F01N 1/003 181/282 |
| 4,109,751 | A | 8/1978 | Kabele | |
| 4,346,781 | A | 8/1982 | Ingard et al. | |
| 4,924,966 | A | 5/1990 | Kanda et al. | |
| 2005/0252716 | A1 | 11/2005 | Moenssen et al. | |

FOREIGN PATENT DOCUMENTS

| | | |
|---|---|---|
| EP | 0259059 | 3/1998 |
| FR | 831846 | 9/1938 |

* cited by examiner

MUFFLER FOR AN EXHAUST SYSTEM OF AN INTERNAL COMBUSTION ENGINE

CROSS-REFERENCE TO RELATED APPLICATION

This application is a Continuation of U.S. Ser. No. 13/967,121, filed 14 Aug. 2013, which claims benefit of European Patent Application No. 12180707.7, filed on 16 Aug. 2012, and which applications are hereby incorporated herein by reference. To the extent appropriate, a claim of priority is made to each of the above disclosed applications.

TECHNICAL FIELD

The present invention relates to a muffler for an exhaust system of an internal combustion engine.

BACKGROUND

Mufflers are used, for example, as components of exhaust systems of motor vehicles in general, and in particular as components of exhausts systems of cars. For specific types of cars, e.g. sports cars, it is desirable that the sound exiting the exhaust system has a sportive characteristic including sound components which are experienced as having a certain "roughness" (aggressive sound). Roughness sensitivity of humans is highest for amplitude modulated sound where the frequency of the envelope is in the range of 50 Hz to 100 Hz, although also envelope frequencies outside this range may contribute to the experienced roughness, too.

It is known that many so-called "engine orders" contribute to the amplitude modulated sound emitted by the engine, with an engine order being defined as corresponding to one revolution of the crank shaft. By way of example, at 3000 rpm (revolutions per minute) of the crank shaft the first engine order is 50 Hz (i.e. the first engine order corresponds to the rotational frequency of the crank shaft). In particular the "higher engine orders" (second and higher engine orders), that is to say multiples of the first engine order are known to contribute to the amplitude modulated sound which is responsible for the experienced roughness. Therefore, to achieve a sportive sound characteristic it is important that the higher engine orders are contained in the sound exiting the exhaust system.

To preserve the higher engine orders in the sound coming from the engine and allowing these higher engine orders to exit the exhaust system to create the sportive sound, a known two-branch exhaust component comprises a conventional muffler arranged in a first branch of the two-branch exhaust component and a bypass pipe arranged in the second branch of the two-branch component. The muffler in the first branch comprises a relatively voluminous casing in the inner space of which attenuating elements may be arranged for attenuating all types of sound passing through the inner space of the muffler and thus very substantially reducing the overall noise emitted by the engine, so that the noise exiting the exhaust system is very substantially reduced. The bypass pipe in the second branch is essentially a conventional pipe which is sized and shaped to allow the higher engine orders to pass through thus forming an acoustic bypass. The two branches are re-joined again downstream of the muffler.

While this is an acceptable and well-working constructional approach for an exhaust component from the perspective of achieving a reduced overall sound level emitted from the exhaust system and at the same time providing for a sportive sound characteristic, this constructional approach suffers from some disadvantages.

A first disadvantage is that due to the comparatively large surface of the casing of the muffler, cooling of the muffler by the ambient air is much more effective than cooling of the bypass pipe which has a comparatively small surface that is exposed to the ambient air. Accordingly, thermal expansion caused by the hot exhaust gas flowing through the two branches may lead to different lengths of the two branches. Since the two-branch component is typically mounted between an upstream exhaust pipe and a downstream exhaust pipe this different thermal expansion must be compensated for to avoid a too high thermal stress in the material which may otherwise result in that the component may get broken. To compensate for the different thermal expansions, at least one flexible element (e.g. a kind of metallic bellows) is arranged in the branch of the bypass pipe. However, such flexible elements are comparatively difficult to manufacture and are costly. A further disadvantage of the described two-branch component is that the construction is rather voluminous so that mounting of the component to the chassis of a car is comparatively space-consuming. A further disadvantage of this constructional approach is that pressure losses are generated in the two Y-joints splitting the exhaust pipe to form the two branches and re-joining the two branches again.

A further known exhaust component comprises a muffler comprising a casing and a pipe extending through the casing. The pipe comprises one or more branch conduits branching off of the pipe wall. The branch conduit(s) open(s) out into the interior of the casing. While this constructional approach is more compact than the constructional approach discussed above, it suffers from the disadvantage that pipes comprising one or more branch conduits branching off of the pipe wall are comparatively difficult and expensive to manufacture. An additional disadvantage is that the cut-off frequency of the high pass filter so formed cannot easily be tuned within the desired bandwidth without departing from the range of typical dimensions of the branched pipes.

Therefore, it is an object of the invention to provide a muffler that overcomes the above-described disadvantages while at the same time allowing higher engine orders to pass through so that the sound exiting the exhaust system has a sportive sound characteristic.

SUMMARY

In accordance with the invention, this object is achieved by a muffler for an exhaust system of an internal combustion engine as it is characterized by the features of the independent claim. Further advantageous aspects are the subject of the dependent claims.

In accordance with the invention, the muffler for an exhaust system of an internal combustion engine comprises: a casing having an inner space, an inlet pipe for sound to enter the muffler, an outlet pipe for sound to exit the muffler, and a separation wall arranged to extend from the inlet pipe to the outlet pipe and being embodied in a manner such as to define first and second acoustical ducts extending through the casing to allow sound propagating along the first acoustical duct to enter the inner space of the casing and to thereafter exit the inner space of the casing again, and to allow sound propagating along the second acoustical duct to acoustically bypass the inner space of the casing, wherein the muffler, including the inner space of the casing, the inlet pipe, the outlet pipe and the separation wall, is sized and shaped to form a high pass filter having a cut-off frequency which is in the range of 200 Hz to 800 Hz.

The muffler according to the invention allows for tuning of the cut-off frequency in the afore-mentioned range by changing the size or shape (or both) of the inner space, the inlet pipe and the outlet pipe, and their arrangement relative to one another. As a result thereof, the (relevant) higher engine orders are allowed to pass through in order to preserve the sportive sound characteristic.

The separation wall can be embodied differently, as will be explained further below, as long as it establishes two different acoustical ducts, so that one portion of the sound propagates through a first acoustical duct comprising a duct-volume (inner space of the casing)-duct arrangement, whereas another portion of the sound propagates through a second acoustical duct which is acoustically bypasses the inner space of the casing of the muffler. For example, the separation wall may be embodied as an inner pipe, or it may be embodied as a transverse separation wall arranged within a continuous pipe forming the inlet and outlet pipe, without these embodiment being exhaustive. The inlet and outlet pipes as well as the separation wall (embodied as inner pipe or as transverse separation wall) can be made of very thin metal so as to allow the reduction of weight when compared with prior art constructional approaches. Such weight reduction ultimately results in reduced fuel consumption and reduced $CO_2$ emissions, thus being more favourable with respect to environmental aspects. Also, pressure losses like those caused by the Y-joints before and after the two branches in the prior art construction discussed above do not occur, thus further reducing fuel consumption and $CO_2$ emissions.

In accordance with one aspect of the invention, the inlet pipe has an internal inlet pipe opening (into the inner space of the casing) for sound propagating along the first acoustical duct to enter the inner space of the casing, and the outlet pipe has an internal outlet pipe opening (out of the inner space of the casing) through which sound may exit the inner space of the casing. The separation wall includes an inner pipe arranged to extend at least from the internal inlet pipe opening to the internal outlet pipe opening.

This is a so-called "pipe-in-pipe" construction. For example, the inlet pipe as well as the outlet pipe can be fixedly attached (e.g. through welding) to the casing, so that the muffler can be attached to the exhaust system by connecting the inlet pipe to the upstream exhaust pipe and the outlet pipe to the downstream exhaust pipe. A part of the sound enters the inner space of the casing through the internal inlet pipe opening of the inlet pipe and exits from the inner space of the casing through the internal outlet pipe opening of the outlet pipe. The inner pipe forms an acoustical bypass that extends at least between the internal inlet opening of the inlet pipe and the internal outlet opening of the outlet pipe.

The "pipe-in-pipe" construction of the muffler according to the invention is a compact space-saving construction. Elements for compensating different thermal expansion which are difficult to manufacture and which are costly can be avoided. Moreover, no branch conduits branching off of a pipe wall are needed and, accordingly, the "pipe-in-pipe" construction—apart from the casing—comprises only simple conventional pipes, so that the muffler and its components are easy to manufacture.

Again, the muffler according to the invention, including the inner space of the casing, the inlet pipe, the outlet pipe and the inner pipe, is sized and shaped such that the muffler as a whole forms a high pass filter the cut-off frequency of which can be tuned such that the (relevant) higher engine orders are allowed to pass through so as to preserve the sportive sound characteristic. The inner pipe may form a duct which is acoustically separated from the inner space of the casing and may even be hermetically separated from the inner space of the casing, or may form a duct which is to some extent connected to the inner space of the casing, for example by comprising a number of holes provided in its wall. In any event, each of the measures is applied such that the cut-off frequency is such that the (relevant) higher engine orders are allowed to pass through so as to preserve the sportive sound characteristic.

According to a further aspect of the invention, the inner pipe has an overall length such that the inner pipe extends through the internal inlet pipe opening into the inlet pipe by a first insertion length and through the internal outlet pipe opening into the outlet pipe by a second insertion length. This makes sure that the part of the sound propagating through the inner pipe enters the inner pipe at a location upstream of the internal inlet opening of the inlet pipe. Likewise, the sound that has passed through the inner pipe exits the inner pipe at a location downstream of the internal outlet opening of the outlet tube. The insertion length can be used, for example, for tuning the cut-off frequency of the high pass filter since that portion between the location in the inlet tube where the inner pipe starts and the location of the internal inlet pipe opening as well as that portion between the internal outlet pipe opening and the location where the inner pipe ends in the outlet pipe both form an acoustical inductance.

According to one aspect of the invention, the inner pipe is fixed either only to the inlet pipe or is fixed only to the outlet pipe, and the outlet pipe or the inlet pipe to which the inner pipe is not fixed has a larger cross-sectional size than the cross-sectional size of the inlet pipe or outlet pipe to which the inner pipe is fixed.

When the mufflers are mounted to the chassis of a car, in operation they are exposed to mechanical vibrations. Since the inner pipe is fixed only to the inlet pipe or only to the outlet pipe the free end of the inner pipe (that end which is not fixed) may vibrate. In order to avoid mechanical contact between the free end of the inner pipe and the respective inlet pipe or outlet pipe upon vibration, the cross-sectional size of the respective inlet pipe or outlet pipe is sufficiently large, since such mechanical contact would result in rattling noises which are undesirable and may also negatively affect the lifetime of the muffler.

According to another aspect of the invention which may or may not be combined with the afore-mentioned aspect, the inner pipe is fixed either only to the inlet pipe or is fixed only to the outlet pipe. The inner pipe comprises a bent portion which is bent towards the center of the internal outlet pipe opening or towards the center of the inlet pipe opening to which the inner pipe is not fixed. This is also a constructive approach to avoid unintended rattling noises. The term "bent portion" includes every type of bending curvature which is technically feasible and is not limited to a particular bending method. The term "bent towards the center" includes every form which increases the distance between the inner pipe and the wall of the inlet pipe or the outlet pipe.

According to yet another aspect of the invention, the inner pipe is fixed to both, the inlet pipe and the outlet pipe. The inner pipe comprises a compensation element for compensating the thermal expansion of the inner pipe which is fixed to the inlet pipe and to the outlet pipe. Fixation of the inner pipe to both the inlet pipe and the outlet pipe provides for an increased mechanical stability of the inner pipe when compared to a single connection of the inner pipe to only one of the inlet pipe and outlet pipe. On the other hand, such fixation of the inner pipe to both the inlet pipe and the outlet pipe may cause problems upon thermal expansion and may cause high thermal stresses in the inner pipe or may cause the inner pipe to deform, since the cooling of the casing by the ambient air is much more efficient than the cooling of the inner pipe. The compensation element allows for compensation of the larger thermal expansion of the inner pipe while maintaining the advantage of the increased stability provided for by the fixation of the inner pipe to both, the inlet pipe and the outlet pipe.

In accordance with a further aspect of the invention, the inlet pipe has a first longitudinal axis and the outlet pipe has a second longitudinal axis. The first longitudinal axis and the second longitudinal axis are arranged parallel to one another (but not coincident). By arranging the inlet pipe and outlet pipe parallel to one another, the internal inlet opening and the internal outlet opening are offset relative to each other. The offset between the internal inlet pipe opening and the internal outlet pipe opening allows to fix the inner pipe to either the inlet pipe or to the outlet pipe, and at the same time due to the offset outlet pipe or inlet pipe, respectively, the free end of the inner pipe is arranged sufficiently spaced from the outlet pipe or the inlet pipe so as to avoid mechanical contact.

According to a further aspect of the invention, the inner pipe has a screw-shaped outer contour having an outer diameter such that the inner pipe firmly fits into the inlet pipe and into the outlet pipe. The screw shaped outer contour on one hand provides for a firm fit of the inner pipe in the inlet pipe and the outlet pipe. The firm fit is established along the entire part of the outer contour of the inner pipe which is arranged in the inlet pipe and the outlet pipe. A portion of the sound propagates through the "grooves" of the screw-shaped outer contour and enters the inner space of the casing (assuming that the outer contour is at least partially arranged in the inlet pipe). Upon exiting the inner space of the casing, this portion of the sound passes along the "grooves" of the screw-shaped outer contour. The other portion of the sound propagates through the inner pipe.

According to another aspect of the invention, the inlet pipe and the outlet pipe are formed by a continuous pipe completely extending through the casing and having at least one opening for sound to enter into and to exit from the inner space of the casing. The term "continuous pipe" is meant to describe a pipe that completely extends through the entire casing so that one end of the continuous pipe can be connected to an upstream exhaust pipe of the exhaust system and the other end of the continuous pipe can be connected to a downstream exhaust pipe of the exhaust system. Instead of having an inlet pipe having a dedicated internal inlet opening through which sound enters the inner space of the casing and an outlet pipe having a dedicated internal outlet opening through which sound exits the inner space of the casing, the continuous pipe which completely extends through the inner space comprises at least one opening (in its otherwise closed wall) for sound to enter into and exit the inner space through said at least one opening. The inner pipe is arranged in the said continuous pipe. This embodiment may impart good stability to the muffler with respect to vibrations that occur in operation (i.e. when being mounted to the chassis of the car).

According to one aspect of the invention, the continuous pipe is a single continuous pipe and comprises an integral compensation element for compensating thermal expansion of the single continuous pipe. The single continuous pipe is a single piece (which is either made from one single piece or which is made of two or more pieces which are welded together to form a single piece after welding, or which is joined by another suitable joining technique such as e.g. brazing) and does not have any flexible joints or separations in longitudinal direction. This may lead to thermal stress in the single continuous pipe which is connected to the casing, since cooling of the casing through the ambient air is much more effective (due to the large surface of the casing) than cooling of the single continuous pipe extending through the interior of the casing which has a much smaller surface which additionally is not exposed to the ambient air, so that the thermal expansion of the single continuous pipe is larger than that of the casing. To avoid such thermal stress in the single continuous pipe, the single continuous pipe comprises an integral compensation element, which may for example be embodied as metal bellows which can be made separately and welded between two pipe pieces so as to form a single continuous pipe having an integral compensation element.

According to another aspect of the invention, the continuous pipe comprises separate first and second pipes, and further comprises a compensation element slidably connecting the first and second pipes to form the continuous pipe. The first pipe and the second pipe are connected by the slidable compensation element so that the connection element does not have to be integral with the single continuous pipe. Such slidable connection element is easy to manufacture. The compensation element allows linear movement of the first pipe and the second pipe relative to one another in order to compensate for the different thermal expansions of the casing and the first and second pipes.

In accordance with yet another aspect of the invention, the inlet pipe or the outlet pipe or the continuous pipe (whichever is applicable) comprises projections extending inwardly from an inner wall of the inlet pipe or the outlet pipe or the continuous pipe. The projections are distributed circumferentially at different angular positions on the inner wall and protrude inwardly for a depth such as to fixedly mount the inner pipe. In principle, the shape and number of projections for fixedly mounting the inner pipe is not limited but can be chosen to provide a fixed support for the inner pipe so that the inner pipe is fixedly mounted to prevent it from vibrating when the muffler is in use. For example, multiples of three projections angularly spaced along the inner circumference of the continuous outer pipe by 120° may be provided. The three projections of a triple of projections angularly spaced by 120° advantageously are also spaced from one another in the longitudinal direction of the continuous pipe in order to reduce backpressure when compared to an arrangement of three projections of a triple of projections which are all arranged at the same longitudinal position.

In accordance with yet another aspect of the invention, the inner pipe forms a duct which is acoustically separated from the inner space of the casing, and in particular the inner pipe may be configured to hermetically separate the duct from the inner space. The term "acoustically separated" may also include cases in which there is a very small "leakage" between the duct and the inner space of the casing so that exhaust gases passing through the duct may to a very small extent (only a few percent) enter into the casing even though they travel through the duct. The term "hermetically separate" is to be understood in the sense that there is no such exhaust gas "leakage" anymore.

When discussing the pipe-in-pipe construction it has been outlined that generally the inner pipe may be acoustically separated or may even be hermetically separated from the inner space of the casing, or that it may be connected to the inner space of the casing. Both constructional options are possible, and this has to be taken into consideration when tuning the cut-off frequency of the high pass filter.

According to another aspect of the invention, the inlet pipe and the outlet pipe are formed by a continuous pipe completely extending through the casing, however, the separation wall is a transverse wall arranged within the continuous pipe so as to partition the continuous pipe into the first and second acoustical ducts. The continuous pipe has at least one opening in its wall at a location allowing sound propagating through the first acoustical duct to enter into and exit from the inner space of the casing.

This constructional approach is not a pipe-in-pipe construction but rather partitions the interior of one continuous pipe (with or without compensation element) into two partitions with the aid of the transverse wall. This constructional approach has a reduced number of separate parts since it does no longer have an inner pipe but nevertheless provides a duct which is acoustically separated from the inner space of the casing.

DESCRIPTION OF THE DRAWINGS

Further advantageous aspects of the invention become apparent from the following description of embodiments of the muffler according to the invention with reference to the schematic drawings in which.

DETAILED DESCRIPTION OF THE INVENTION

Figure 1:
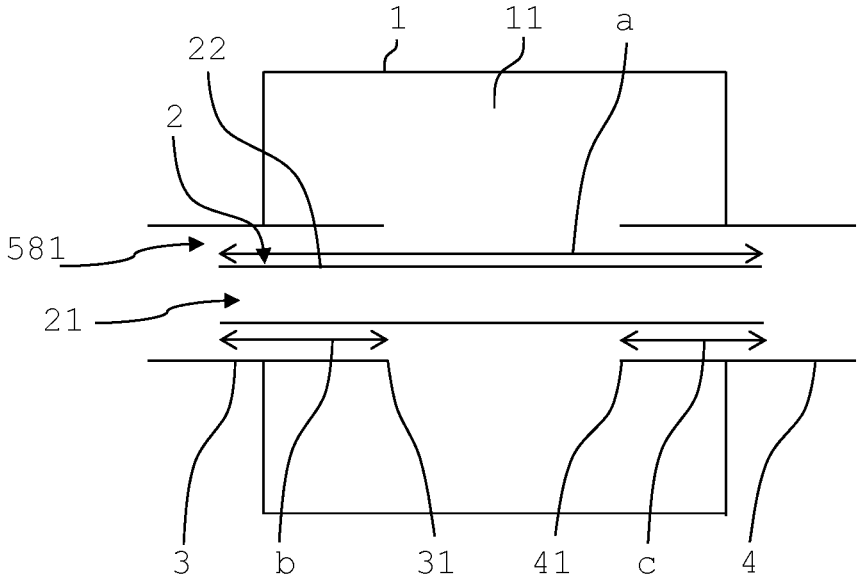
FIG. 1 shows a first embodiment of the muffler according to the invention.

Further advantageous aspects of the invention become apparent from the following description of embodiments of the muffler according to the invention with reference to the schematic drawings in which:

FIG. 1 shows an embodiment of the muffler according to the invention. The muffler comprises a casing 1 with an inner space 11, an inlet pipe 3, an internal inlet pipe opening 31, an outlet pipe 4, an internal outlet pipe opening 41, and a separation wall 2 in the form of an inner pipe 22 which forms a duct 21 that is acoustically separated from the inner space 11 of casing 1 (although this is not mandatory, as explained above). It is to be mentioned, that the pipes may have a cross-section other than circular, although circular cross-sections may be preferred from a manufacturing point of view.

The muffler may form a component of an exhaust system of an internal combustion engine by connecting inlet pipe 3 to an upstream exhaust pipe (not shown) through which exhaust gas coming from the engine enters the muffler. The exhaust gas flows through inlet pipe 3 and a portion of the exhaust gas stream enters inner space 11 of the casing 1 through internal inlet pipe opening 31 (first acoustical duct 581 for the sound) while another portion of the exhaust gas stream flows through inner pipe 22 (second acoustical duct 21 for the sound). For exiting inner space 11, the exhaust gas flows through internal outlet pipe opening 41 into outlet pipe 4 which is connected to the downstream exhaust pipe, and from there further towards the end pipe of the exhaust system. That portion of the sound propagating in the exhaust gas along the first acoustical duct is acoustically attenuated in the inner space 11 of casing 1 in the manner well-known in the art. For attenuation of the sound, the size and shape of the casing 1 can be adapted to provide an inner space 11 in which the sound propagating through the exhaust gas interferes in a manner such as to get attenuated. Additional acoustic attenuation elements (not shown in FIG. 1) can be arranged in the inner space 11 of the casing 1, for example baffles or other elements which may or may not be provided with a sound absorbing covering layer. Inner pipe 22 extends into the inlet pipe 3 by a first insertion length b and into the outlet pipe 4 by a second insertion length c. Sound propagating through the interior of inner pipe 22, that is to say along second acoustical duct 21, is acoustically separated from the inner space 11, since it exits inner pipe 22 at a location which is arranged downstream of inner space 11, so that inner space 11 is bypassed. To prevent sound propagating through inner pipe 22 to enter inner space 11, inner pipe 22 has a gas-tight wall so that second acoustical duct 21 is hermetically separated from inner space 11 of casing 1. The portion of the sound that has passed along first acoustical duct 581 and through inner space 11 and the portion of the sound that has passed along second acoustical duct 21 come together again within outlet pipe 4.

The size of the inner space 11 of the casing 1, of the inlet pipe 3, of the outlet pipe 4, of the inner pipe 22, as well as the insertion length b of the inner pipe 22 into the inlet pipe 3 as well as the insertion length c of the inner pipe 22 into the outlet pipe 4 are chosen such that the muffler as a whole acts as a high pass filter having a desired cut-off frequency. This cut-off frequency is chosen such that higher engine orders are allowed to pass through the muffler as a whole. Since the higher engine orders are known to be important for the sportive sound characteristic, they are thus preserved in the sound emitted from the exhaust system downstream of the muffler.

In this manner, a compact muffler is formed by having inner pipe 22 (or more generally the separation wall 2) extend through the inner space of the casing 1 and still preserving the higher engine orders in the sound emitted by the exhaust system to achieve a sportive sound characteristic. At the same time, the compact muffler is easy and comparatively inexpensive to manufacture.

Figure 2:
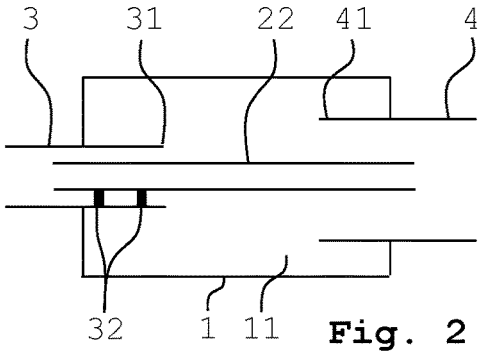
FIG. 2 shows an embodiment of the muffler according to the invention, with the inner pipe being fixed only to the inlet pipe.

FIG. 2 shows a further embodiment of the muffler according to the invention. In the embodiment shown in FIG. 2, outlet pipe 4 has a larger cross-section than inlet pipe 3. In operation, an exhaust system mounted to the chassis of a car including its components is exposed to mechanical vibrations (which are caused by vibrations of the engine as well as by the movement of the car). To prevent rattling noises coming from the inner pipe 22 striking against inlet pipe 3 or outlet pipe 4, inner pipe 22 is fixed to inlet pipe 3, for example with the aid of fasteners 32, so that no striking of inner pipe 22 against inlet pipe 3 is possible. However, the other end of inner pipe 22 is a free end, meaning that it is not connected to outlet pipe 4. This is advantageous in that in case thermal expansions of inner pipe 22 occur these are not obstructed by fixations provided at both ends of inner pipe. On the other hand, it must be prevented that the free end of inner pipe 22 may strike against outlet pipe 4. For that purpose, outlet pipe 4 has a larger cross-section which is chosen such that the typical vibrations occurring in operation do not lead to the inner pipe 22 striking against outlet pipe 4. It goes without saying that for this embodiment as well as for all other embodiments described herein in which inner pipe 22 is fixed only to inlet pipe 3, inner pipe 22 could also be fixed only to outlet pipe 4 and the respective measures suggested are similarly applicable.

Figure 3:
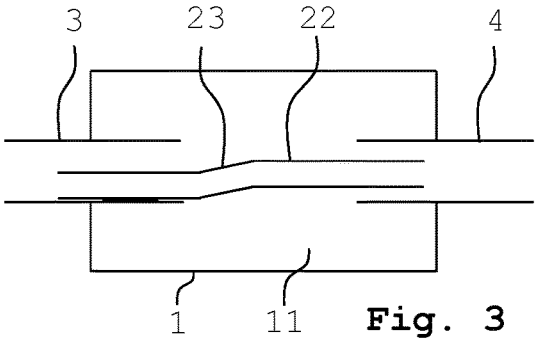
FIG. 3 shows an embodiment of the muffler according to the invention, with the inner pipe having a bent portion.
Figure 4:
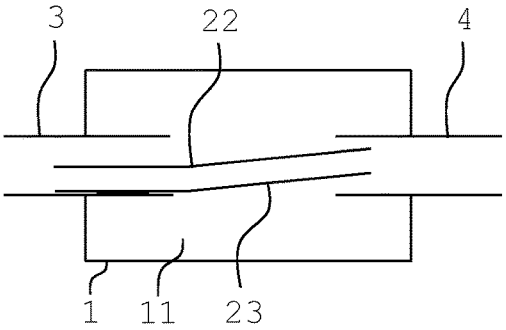
FIG. 4 shows an embodiment of the muffler according to the invention with the inner pipe having a differently bent portion.

Further embodiments of the muffler according to the invention in which the one end of inner pipe 22 is fixed to inlet pipe 3 and in which the other end of inner pipe 3 is a free end are shown in FIG. 3 and FIG. 4. In both embodiments inner pipe 22 comprises a bent portion 23. In the embodiment shown in FIG. 3, only a short length portion of inner pipe 22 is bent when compared to the lengths of the parallel running upstream and downstream portions of inner pipe 22. In contrast thereto, in the embodiment shown in FIG. 4 a major portion of inner pipe 22 is bent. Both embodiments only represent examples of how bent portions may look like meaning that it is possible to adapt the bent portions to meet other requirements imposed, for example by the location where outlet pipe 4 is arranged relative to the casing and relative to inlet pipe 3.

Figure 5:
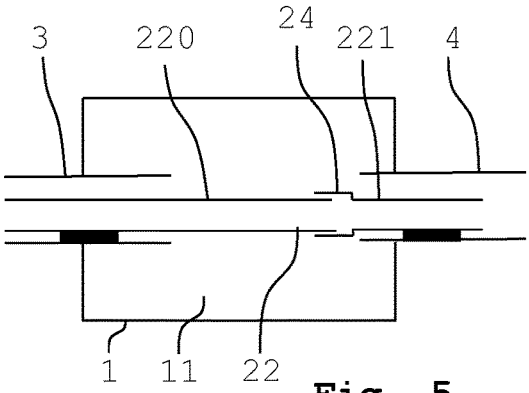
FIG. 5 shows an embodiment of the muffler according to the invention, with the inner pipe being fixed to the inlet pipe and to the outlet pipe, and with a compensation element.

FIG. 5 shows an embodiment of the muffler according to the invention which comprises an inner pipe 22 which is fixed to the inlet pipe 3 and which is also fixed to the outlet pipe 4. It is evident that fixation of inner pipe 22 to both the inlet pipe 3 and the outlet pipe 4 is advantageous with respect to preventing striking of the inner pipe 22 against inlet pipe 3 and outlet pipe 4. On the other hand, upon thermal expansion the comparatively hot inner pipe 22 expands to a larger extent than does the comparatively cold inlet pipe 3 or outlet pipe 4 which are connected to the casing 1 having a large surface that is exposed to the ambient air and is cooled by the ambient air. In order to avoid excessive thermal stress in inner pipe 22 or to prevent inner pipe 22 from breaking, inner pipe 22 is comprised of two inner pipe pieces 220 and 221 which are joined to each other by a compensation element 24 that allows for the compensation in length during thermal expansion.

Fixation of the inner pipe 22 to inlet pipe 3 (embodiment shown in FIG. 2, FIG. 3 and FIG. 4) or to outlet pipe 4 or to both the inlet pipe 3 and the outlet pipe 4 can be performed by any suitable fixation techniques such as welding, brazing, or by any mechanical locking techniques (e.g. form-locking joints) which are known in the art.

Returning to FIG. 5, compensation element 24 is embodied as a "slip joint" meaning that one of the inner pipe pieces, for example inner pipe piece 220, is movable relative to the other inner pipe piece 221 in axial direction. At the same time, however, the acoustical separation of second acoustical duct 21 (see FIG. 1) from the inner space 11 of casing 1 is maintained.

Figure 12:
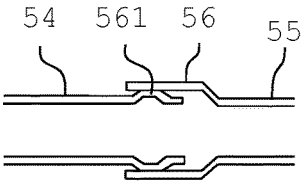
FIG. 12 shows an embodiment of a slidable connection of the first and the second pipes, the slidable connection comprising a corrugation.
Figure 13:
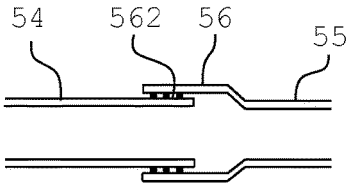
FIG. 13 shows another embodiment of a slidable connection of the first and the second pipes, the slidable connection comprising a wire mesh.

While not being exhaustive, two embodiments how such slip joint may be realized are shown in FIG. 12 and FIG. 13, respectively. Although they are shown there in connection with a pipe extending completely through the inner space of the casing, they are similarly applicable for inner pipe 22 and the two inner pipe pieces 220 and 221. In the embodiment shown in FIG. 12 the compensation element comprises a corrugation 561 at one end of a pipe piece 54 which is arranged in an enlarged portion 56 of the other pipe piece 55 to be fittingly arranged therein while at the same time being movable there in the longitudinal direction (axial direction). In the embodiment shown in FIG. 13, however, compensation element is embodied as a wire mesh which is arranged around the end of the one pipe piece and between the end of this one pipe piece and an enlarged portion of the other pipe piece. As an alternative, in case inner pipe 22 is a single piece inner pipe 22, a bellows-like compensation element (see FIG. 10) is also conceivable, although a bellows-like compensation element may be more expensive to manufacture.

Figure 6:
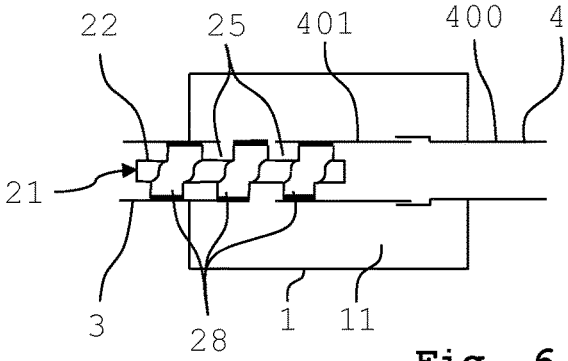
FIG. 6 shows an embodiment of the muffler according to the invention, with the inner pipe having a screw-shaped outer contour.

FIG. 6 shows a further embodiment of the muffler according to the invention, in which inner pipe 22 has a screw-shaped outer contour 28. In addition, in this embodiment outlet pipe 4 is comprised of two outlet pipe pieces 400 and 401 which are connected to each other by a slip joint as already described above. Inner pipe 22 extends into inlet pipe 3 as well as into outlet pipe piece 400, with the outer contour 28 having a diameter such that the screw-shaped outer contour 28 of inner pipe 22 firmly fits into inlet pipe 3 and into outlet pipe piece 400. The slip joint at the connection of outlet pipe pieces 400 and 401 serves for compensation of different thermal expansions, as has already been explained above.

Exhaust gas and together with it the sound generally propagates along two different acoustical ducts. The first acoustical duct includes a spiral channel 25 extending helically along the outer surface of inner pipe 22, the spiral duct being formed by the "grooves" of the screw-shaped outer contour 28. The sound propagating along this first acoustical duct then enters inner space 11 of casing 1 and continues to propagate along spiral channel 25 formed by the "grooves" of the screw-shaped outer contour 28 of inner pipe 22 arranged in outlet pipe piece 401. Once it exits the spiral channel 25, it further propagates through outlet pipe pieces 401 and 400.

The second acoustical duct is formed by the interior of inner pipe 22. This duct is acoustically separated from the afore-described first acoustical duct and bypasses the inner space 11 of casing 1. As the sound exits inner pipe 22 it comes together with the sound that has propagated through the "grooves" of the screw-shaped outer contour 28, and the sound then further propagates through outer outlet pipe pieces 401 and 400. Again, the muffler as a whole forms the high pass filter having the desired cut-off frequency.

Figure 7:
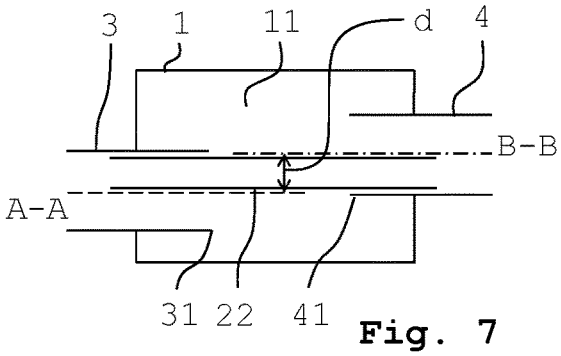
FIG. 7 shows an embodiment of the muffler according to the invention with the axes of the inlet pipe and of the outlet pipe being offset parallel to one another.
Figure 8:
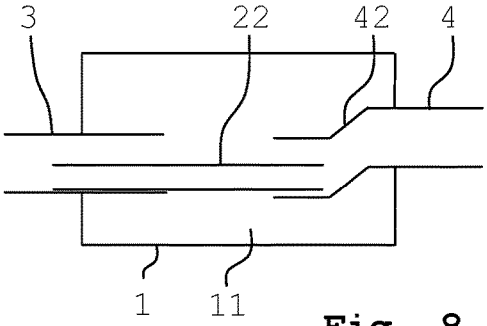
FIG. 8 shows an embodiment of the muffler according to the invention with axes of the inlet pipe and of the outlet pipe being offset parallel to one another, and with the outlet pipe having a bent portion.

FIG. 7 and FIG. 8 show further embodiments of the muffler according to the invention. In both embodiments, the longitudinal axes of the inlet pipe and of the outlet pipe are arranged parallel to one another (but do not coincide) with an offset. As can be seen in FIG. 7, inlet pipe 3 has a first longitudinal axis A-A and outlet pipe 4 has a second longitudinal axis B-B. The inlet pipe 3 and the outlet pipe 4 are arranged relative to one another so that the first longitudinal axis A-A and the second longitudinal axis B-B are arranged parallel to one another with an offset d between the axes A-A and B-B. In the embodiment of FIG. 8, the inner pipe 22 comprises a bent portion whereas in the embodiment of FIG. 7 the inner pipe is a straight pipe without any bent portion. These are embodiments which take account of requirements regarding the location of the inlet pipe 3 and of the outlet pipe 4, respectively, and at the same time the inner pipe is arranged such that rattling noises are avoided.

Figure 9:
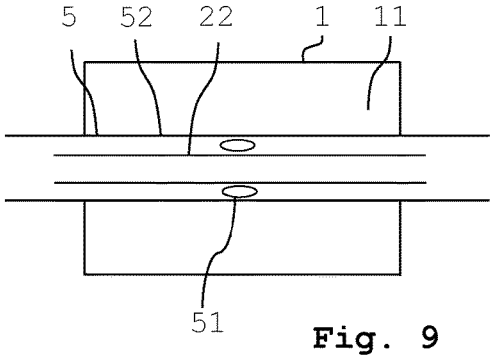
FIG. 9 shows an embodiment of the muffler according to the invention having a continuous pipe extending through the casing.
Figure 10:
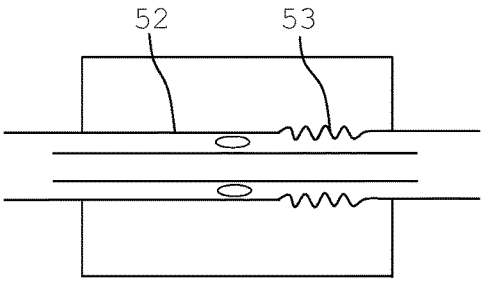
FIG. 10 shows a variant of the embodiment of the muffler of FIG. 9, the continuous pipe having an integral corrugated compensation element.
Figure 11:
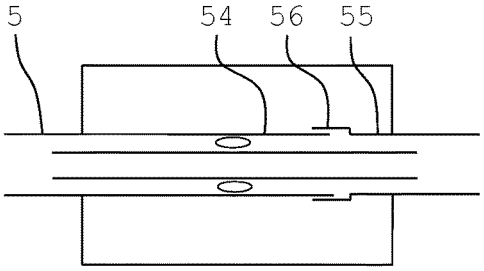
FIG. 11 shows an embodiment of the muffler according to the invention having a continuous pipe comprising first and second pipes and a compensation element slidably connecting the first and a second pipes.

FIG. 9, FIG. 10 and FIG. 11 show embodiments of the muffler according to the invention comprising a continuous pipe 5 (inlet pipe and outlet pipe are formed by continuous pipe 5) which completely extends through the inner space 11 of casing 1, however, continuous pipe 5 is provided with one or more openings 51 which allow sound passing through continuous pipe 5 to exit continuous pipe 5 and enter inner space 11 of casing 1 through the openings 51 and which allow sound to exit inner space 11 of casing 1 and to re-enter continuous pipe 5. Inner pipe 22 is arranged within continuous pipe 5 and represents a bypass conduit defining the second acoustical duct acoustically bypassing the inner space of casing 1.

FIG. 9 and FIG. 10 are embodiments where the continuous pipe 5 is a single continuous pipe 52, and in FIG. 10 there is additionally provided an integral compensation element in single continuous pipe 52 for compensating thermal expansions in length. Compensation element 53 has the form of a corrugated portion 53 being formed in the wall of single continuous pipe 52. While it can easily be seen, that the single continuous pipe 52 shown in FIG. 9 can be made from one single piece, it can also be made from more than one individual pieces which are welded together (or which are joined together by any other suitable joining technique, e.g. through brazing) to form the single continuous pipe. As regards FIG. 10 and has been discussed further above, compensation element 53 can be manufactured separately and can be welded to two pipe portions so as to form the single continuous pipe having the integral compensation element.

In the embodiment shown in FIG. 11, continuous pipe 5 is comprised of a separate first pipe 54 and a separate second pipe 55 which are slidably connected by a compensation element 56 which allows for compensation of thermal expansions in length and at the same time does not allow sound to enter the inner space 11 of casing 1. However, as already explained above, the acoustical separation is not mandatory so that at the slidable connection of the first pipe 55 and the second pipe 56 there may be a desired acoustical leakage into the inner space 11 of casing 1.

In the embodiment of FIG. 12, compensation element 56 comprises a corrugation 561 formed in the end of first pipe 54, this corrugation 561 being arranged in an enlarged portion of second pipe 55.

In the embodiment shown in FIG. 13, compensation element 56 comprises a wire mesh 562 which is arranged to surround the end of first pipe 54 and which is arranged between the end of this first pipe 54 and an enlarged portion of second pipe 55. With respect to the slidable connection it is also referred to the description above in connection with the inner pipe 22.

Figure 14:
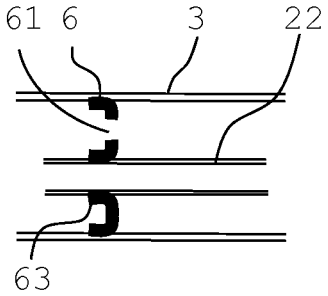
FIG. 14 shows an embodiment of a fixed arrangement of an inner pipe in an inlet pipe (see FIG. 2) with the aid of a baffle having an opening.
Figure 15:
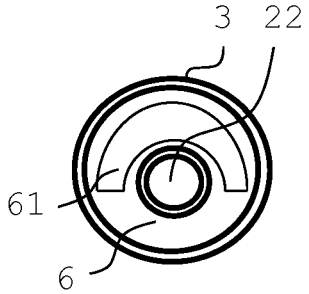
FIG. 15 shows a view from the left of the embodiment of FIG. 14.

In FIG. 14 and FIG. 15 an embodiment of a fixed arrangement of an inner pipe 22 in the inlet pipe 3 is shown. As can be seen, a baffle 6 (similar to a plate) is provided that comprises a crescent-shaped opening 61. Baffle 6 supports inner pipe 22 so that it is fixedly arranged. A portion of the sound may propagate along the first acoustical duct through opening 61 to enter into the inner space of the casing of the muffler (not shown), and another portion of the sound propagates along the second acoustical duct, i.e. through inner pipe 22, and bypasses the inner space of the casing of the muffler, as this has been described above in detail.

Figure 16:
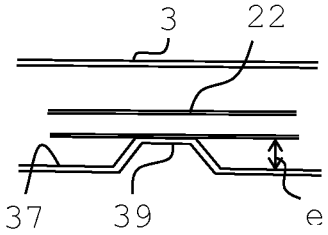
FIG. 16 shows an embodiment of a fixed arrangement of an inner pipe in an inlet pipe with the aid of projections extending inwardly from an inner wall of the single continuous pipe.
Figure 17:
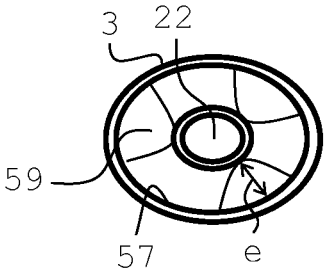
FIG. 17 shows a view from the left of the embodiment of FIG. 16.

In FIG. 16 and FIG. 17 a further embodiment of a fixed arrangement of an inner pipe 22 in the inlet pipe 3 is shown. As can be seen, in this embodiment inlet pipe 3 comprises projections 39 which protrude inwardly for a depth e from the inner wall 37 of inlet pipe 3. As can be seen best in FIG. 17, three such projections may protrude from the inner wall of inlet pipe 3 which are distributed circumferentially at different angular positions 120° offset relative to one another, and which are additionally arranged at different longitudinal positions along inlet pipe 3 (so that only one such projection 39 is visible in FIG. 16), although one projection may be sufficient if fixed to the outer wall of inner pipe 22 (e.g. through welding or brazing). The 120° angularly displaced projections 39 which are additionally longitudinally offset relative to each other provide for a stable support of inner pipe 22 and at the same time reduce backpressure when compared to an arrangement of projections 39 which are all arranged at the same longitudinal position (although this is possible as well).

Figure 18:
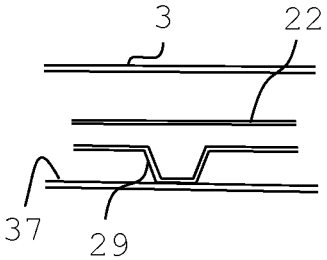
FIG. 18 shows an embodiment of a fixed arrangement of an inner pipe in an inlet pipe with the aid of deformations in the wall of the inner pipe extending outwardly therefrom.
Figure 19:
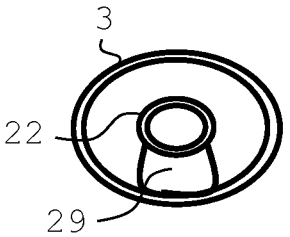
FIG. 19 shows a view from the left of the embodiment of FIG. 18.

In FIG. 18 and FIG. 19 a further embodiment of a fixed arrangement of an inner pipe 22 in the inlet pipe 3 is shown. In this embodiment, one or more projections 29 (embodied as deformations in the wall of inner pipe 22) extend outwardly from inlet pipe 3 to the inner wall 37 of inlet pipe 3. Three such projections may be provided which are not only angularly displaced by 120° but which may additionally be arranged longitudinally offset relative to each other, as has been explained in connection with the embodiment of FIG. 16 and FIG. 17. However, only one such projection may be sufficient, however, such projection must then be fixed (e.g. through welding or brazing) to the inner wall 37 of inlet pipe 3.

This kind of fixation of the inner pipe 22 is not limited to the fixation of the inner pipe 22 to the inner wall 37 of inlet pipe 3 but is also applicable to a fixation of the inner pipe 22 to the outlet pipe 4. Also, it is applicable to the fixation of inner pipe 22 to the continuous pipe 5 completely extending through the inner space of the casing.

Figure 20:
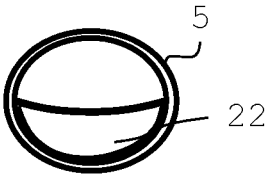
FIG. 20 shows an embodiment of an arrangement of a continuous pipe and an inner pipe arranged therein which has the shape of a half-moon (D-shape)

FIG. 20 shows a sectional view of an embodiment of an arrangement of a continuous pipe 5 and an inner pipe 22 arranged therein which has the shape of a half-moon (D-shape). In this embodiment, the inner pipe 22 does not have to be welded or brazed to be connected to the inner wall of continuous pipe 5, but rather the connection may be formed with the aid of form-locking elements, for example with the aid of dimples which engage into corresponding recesses.

Figure 21:
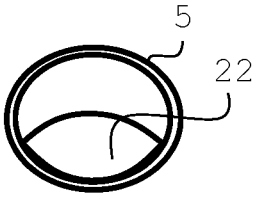
FIG. 21 shows an embodiment of an arrangement of a continuous pipe and an inner pipe arranged therein which has a biconvex shape.

FIG. 21 shows an embodiment of an arrangement of a continuous pipe 5 and an inner pipe 22 arranged therein which has a biconvex shape. Again, the inner pipe 22 does not have to be welded or brazed to be connected to the inner wall of continuous pipe 5, but rather the connection may be formed with the aid of form-locking elements.

Figure 22:
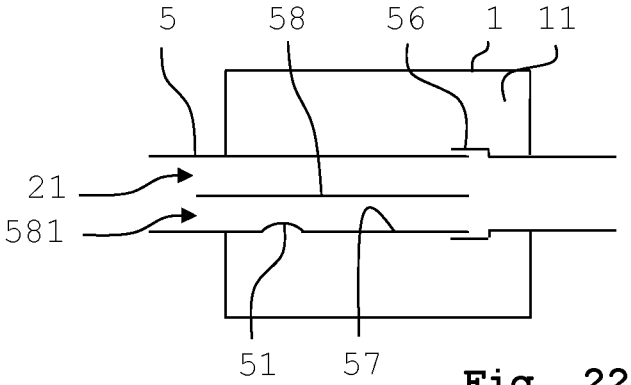
FIG. 22 shows a further embodiment of the muffler according to the invention having a continuous pipe and a transvers wall longitudinally extending through the interior of the continuous pipe.

FIG. 22 shows a further constructional approach of the muffler according to the invention which has a continuous pipe 5 completely extending through casing 11, and a separation wall formed by a transverse wall 58 arranged within continuous pipe 5 so as to partition continuous pipe 5 into the first and second acoustical ducts 581, 21. In FIG. 22 the first and second acoustical ducts are shown as an upper duct 21 (second acoustical duct) and a lower duct 581 (first acoustical duct). Upper duct 21 is bounded by the closed wall of continuous outer pipe 5 and by the closed separation wall 58 which extends transversely from one inner wall of continuous pipe 5 to the oppositely arranged inner wall of continuous pipe, so that sound passing through upper duct 21 acoustically bypasses inner space 11 of casing 1. Lower duct 581, however, is bounded by transverse wall 58 as well as by that part of the wall of continuous pipe 5 in which there are one or more openings 51. Openings 51 are connected to the inner space 11 of casing 1 so that sound may enter through openings 51 into the inner space 11 of casing 1 and may exit the inner space 11 through these openings again. The first and second acoustical ducts 581 and 21 are acoustically separated from one another by transverse wall 58. Compensation element 56 compensates for thermal expansions in length, as this has been described in detail above.

Figure 23:
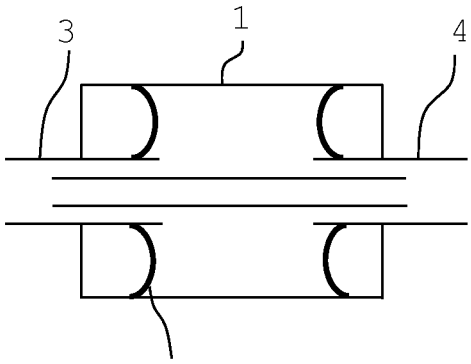
FIG. 23 shows an embodiment of the muffler according to the invention having a casing with baffles arranged therein.

FIG. 23 shows an embodiment of the muffler according to the invention having a casing with baffles 12 arranged therein to support inlet pipe 3 and outlet pipe 4, respectively. This provides for additional stability of the muffler as a whole as well as to inlet pipe 3 and between the casing 1 and the respective inlet pipe 3 and outlet pipe 4. Of course, baffles 12 are preferably also used as acoustical attenuating elements for attenuating sound propagating through the inner space 11 of casing 1.

Figure 24:
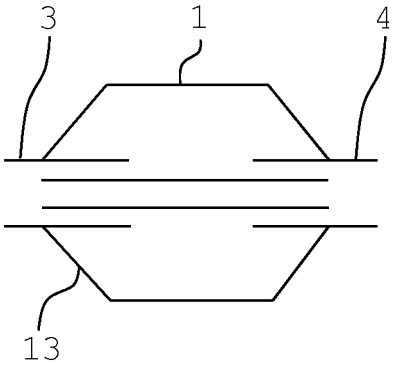
FIG. 24 shows an embodiment of the muffler according to the invention having a casing with conical self-supporting end caps.

FIG. 24 shows an embodiment of the muffler according to the invention having a casing 1 with conical self-supporting end caps 13. Conical end caps 13 provide for a better mechanical stability so that additional stability increasing elements like baffles described before are not necessary.

Embodiments and aspects of the invention have been described with the aid of the drawings. However, various modifications and changes to these embodiments are possible without departing from the general teaching underlying the invention. In particular, combining features of different embodiments is conceivable as long as such combination of features is not contradictory. Therefore, the invention is not to be understood as being limited to the described embodiments, but rather the scope of protection is defined by the appended claims.

The invention claimed is:

1. A muffler for an exhaust system of an internal combustion engine, the muffler comprising a casing having an inner space, an inlet pipe for sound to enter the muffler, an outlet pipe for sound to exit the muffler, and a separation wall arranged to extend from the inlet pipe to the outlet pipe and being embodied in a manner such as to define first and second acoustical ducts extending through the casing to allow sound propagating along the first acoustical duct to enter the inner space of the casing and to thereafter exit the inner space of the casing again, and to allow sound propagating along the second acoustical duct to acoustically bypass the inner space of the casing, wherein the muffler, including the inner space of the casing, the inlet pipe, the outlet pipe and the separation wall, is sized and shaped to form a high pass filter having a cut-off frequency which is in the range of 200 Hz to 800 Hz;

wherein the inlet pipe has an internal inlet pipe opening for sound propagating along the first acoustical duct to enter the inner space of the casing, and wherein the outlet pipe has an internal outlet pipe opening through which sound may exit the inner space of the casing, and wherein the separation wall includes an inner pipe arranged to extend at least from the internal inlet pipe opening to the internal outlet pipe opening, wherein the inner pipe has an overall length such that the inner pipe extends through the internal inlet pipe opening into the inlet pipe by a first insertion length and through the internal outlet pipe opening into the outlet pipe by a second insertion length, wherein the inner pipe is fixed either only to the inlet pipe or is fixed only to the outlet pipe, and wherein the outlet pipe or inlet pipe to which the inner pipe is not fixed has a larger cross-sectional size than the cross-sectional size of the inlet pipe or outlet pipe to which the inner pipe is fixed.

2. A muffler according to claim 1, wherein the inlet pipe has a first longitudinal axis and the outlet pipe has a second longitudinal axis, and wherein the first longitudinal axis and the second longitudinal axis are arranged parallel to one another.

3. A muffler according to claim 1, wherein the inlet pipe or the outlet pipe comprises projections extending inwardly from an inner wall of the inlet pipe or the outlet pipe, the projections being distributed circumferentially at different angular positions on the inner wall of the respective pipe and protruding inwardly for a depth such as to fixedly mount the inner pipe.

4. A muffler according to claim 3, wherein the inner pipe forms the second acoustical duct which is acoustically separated from the inner space of the casing.

5. A muffler according to claim 4, wherein the inner pipe is configured to hermetically separate the second acoustical duct from the inner space of the casing.

* * * * *